United States Patent [19]

Clayton

[11] Patent Number: 4,849,258

[45] Date of Patent: Jul. 18, 1989

[54] MECHANICAL BARREL PLATING-PROCESS AND ARTICLE

[75] Inventor: Erith T. Clayton, Baltimore, Md.

[73] Assignee: Clayton and Colleagues, Inc., Baltimore, Md.

[21] Appl. No.: 48,931

[22] Filed: May 12, 1987

[51] Int. Cl.[4] ..... C23C 24/00

[52] U.S. Cl. ..... 427/242; 427/11; 106/1.05

[58] Field of Search ..... 427/242, 11; 106/1.05

[56] References Cited

U.S. PATENT DOCUMENTS

| | | | |
|---|---|---|---|
| Re. 23,861 | 8/1954 | Clayton | 117/109 |
| 2,640,001 | 5/1953 | Clayton | 117/109 |
| 2,689,808 | 9/1954 | Clayton | 117/131 |
| 2,723,204 | 11/1955 | Pottberg et al. | 117/24 |
| 3,023,127 | 2/1962 | Clayton | 117/109 |
| 3,093,501 | 6/1963 | Clayton | 427/242 |
| 3,132,043 | 5/1964 | Clayton | 117/109 |
| 3,251,711 | 5/1966 | Pottberg et al. | 117/109 |
| 3,268,356 | 8/1966 | Simon | 427/242 |
| 3,328,197 | 6/1967 | Simon | 427/242 |
| 3,443,985 | 5/1969 | Cutcliffe | 117/109 |
| 3,460,977 | 8/1969 | Golben | 427/242 |
| 3,479,209 | 11/1969 | Clayton | 117/109 |
| 4,024,295 | 5/1977 | Chase | 427/216 |

*Primary Examiner*—Sam Silverberg
*Attorney, Agent, or Firm*—Larson and Taylor

[57] ABSTRACT

Major improvements in Mechanical Barrel Plating are virtual elimination of expensive glass impact media, elimination of larger size glass balls such as 3 mm and 5 mm, with replacement by assorted pieces of small high density rubber or equivalent non-staining pieces acting to stay inside the tumbling mass to lift the article in the charge and to interrupt streamline flow to cause random disoriented movement whereby complete uniform coverage of the articles being coated is achieved.

The further improvement resulting from the elimination of large masses of small glass beads and balls creating an open permeable mix permitting easy access of the plating metal powder such as Zinc to the article being coated. For reaching into thread roots, recessed areas, the use of greatly reduced quantities of sharp quartz sand that does not become lodged because of the use of an improved chemistry containing powerful silicon or other lubricants, lodgement being further prevented by the smearing or scraping action of the rubber pieces such as non-staining white neoprene rubber. Alternatively to the quartz sand, small quantities of irregular glass beads so cheap that they can be discarded after each run, or a mixture of quartz and irregular discardable glass beads added to improve smoothness and shine. The use of the rubber pieces serves to prevent chipping and wear on sharp edges permitting use of large heavy objects without damage and with uniform coverage and penetration on all surfaces being plated, and further the optional use of foaming agents to further cushion and distribute the metal power such as Zinc to all surfaces being coated.

12 Claims, No Drawings

MECHANICAL BARREL PLATING-PROCESS AND ARTICLE

BACKGROUND OF THE INVENTION

Mechanical plating in barrels on a commercial scale started in 1954 and, over the years, has grown steadily until today it is a sizeable industry. The plating process has remained essentially stable--it still uses coppering of the work, uses glass beads as impact media, uses Tin, either as metal powder or as Tin Salt. The chemistry has changed little over the years nd generally consists of such chemicals as polyexyethylene amines, polyoxyethylene amids, materials such as carbowax and the like. The flux started in 1954 with Citric Acid which was used for years. When this became too expensive, Clayton introduced Hydroxyacetic Acid (glycolic acid), and when this became too expensive he was the first to introduce Sulphuric Acid which is today almost always used. With the advent of Sulphuric, most suppliers switched to tilting coned open-ended barrels. The barrel operates in a tilted position that causes the Zinc dust to migrate towards the back of the barrel leading to uneven distribution of coating thickness. Another reason for using open-ended barrels is that it permits the use of strong solutions of Sulphuric Acid, strong enough to dissolve unused Zinc from the previous run and to clean the glass impact media. To solve these problems of migration of Zinc uneven coatings, the Zinc and chemicals are added repetitively every few minutes throughout the plating run. This is very labor-intensive as a workman has to stay almost constantly beside the barrel when additions of Zinc dust and chemicals are made every three to five minutes. After the strong acid cleaning in the tilting barrel, the coppering salts are added directly and the coppering proceeds until all the copper is plated on the work. The Tinning steps then follows. The Tin Salts are very expensive, approximately fifteen dollars a pound. The Copper is a toxic metal. Its bright red colors uncoated areas very plainly, and if the coated piece has Copper showing, the addition of the Tin Salts plates over the Copper and so disguises the fact that the Zinc coat is not completely continuous. This system does have the advantage that all of the operations of pickling the work, cleaning the glass beads, coppering, tinning, zinc plating and rinsing all are done in the same barrel. The disadvantage is that the barrel is tied up on all the surface preparation steps cutting down on production and increasing labor costs.

For decades the system was used for plating thin Zinc coatings in the electroplate range of 0.0002 inches to 0.00035 inches, i.e., two-tenths of a mil to three and a half tenths of a mil. With saturation of this market, attention was directed at Zinc plating of large heavy objects with substantial Zinc coatings in the galvanizing thickness range and directly competing with hot-dip galvanizing. Coatings on articles like large bolts had a thickness of 2.1 mil.

For high Zinc efficiency and rapid plating, the mass of glass media needs to be free-flowing and very permeable so the Zinc can move through the media with minimum impedance. When plating heaving work such as large bolts and pole line hardware, their mass and inertia is such that they tend to sink through the media instead of rising nearly to the top of the barrel. Their mass is such that they lack sufficient turn over, or random movement. The impact media needs more lift, and the ability to reorient the work as it tumbles.

To maintain a permeable mass of glass and provide sufficient lift, large glass balls about five millimeters are added. The trouble with the large glass balls is that they are very difficult to pump—so much so that they are another major reason for using the open-ended tilt barrel.

The forced use of the open-ended cone-shaped tilting barrel cuts down on production so much that in a large tilting barrel the actual work may well be reduced by four to six hundred pounds of work over what it would be in a horizontal barrel and the barrel is also tied up during the pickling step. The larger the barrel load the greater the chance of chipping on heavy objects needing a heavy Zinc coating. For reasons such as this and those related above, a maximum load of 2 lbs per object and 12" in length is specified in the 1987 Metal Finishing Handbook in the article on Mechanical Barrel Plating, p. 350. In sharp contrast, with the use of rubber impact, large pieces weighing 4–10 lbs can be plated in bulk without chipping.

These limitations restrict marketability since a large part of the market is lost to competing processes such as hot-dip galvanizing.

The chemistry of the barrel plating appears to have changed little—usually consists of a Sulphuric Acid flux, a mixture of hydrocarbon filming agents or surfactants, and a defoaming agent such as an anti-foaming silicone.

Foam is most undesirable in the barrel because it carries a major portion of the glass beads out of the rotating mass, and may remove virtually all of the finer portions of impact media that are necessary to reach into recessed inaccessible areas such as the thread roots of the workpiece.

From the very early days of commercial mechanical plating in barrels, the impact material has been glass beads or glass balls or a combination of both. They are still universally used today for this purpose.

The glass beads have serious disadvantages:

1. They limit the size of the articles that can be plated. Heavy articles in excess of 1 or 2 pounds break up the glass, especially the finer fractions.

2. Even with the use of larger glass balls, the glass mixture is not very permeable. The Zinc dust has to migrate to the working being plated. Additions of large quantities of Zinc dust seriously hinder the migration of the Zinc powder. The larger the amount of Zinc added, the worse the problem. This has lead to the use of frequent but small additions of Zinc powder.

With constant use there is a breakdown of the finer sizes of glass. These further complicate the migration problem, especially as the broken glass mixed with Zinc powder makes the mixture more impermeable.

It is essential that the glass be cleaned and free of contaminating films. The glass impact media must be thoroughly washed after each run and all unused Zinc removed. This is essential for successful plating in the mechanical plating process.

The handling of a large volume of glass beads is time-consuming and costly especially as usually 2 pounds of glass impact media are used for each pound of work processed. The space occupied by the large mass of glass impact media cuts down the production per barrel load and the removal and return of glass for each plating cycle further reduces production because of the time lost.

The above is believed to be an accurate recital of the present Mechanical Plating in Barrels and especially the mechanical plating of heavy objects. This recital of the prior art is necessary to understand the improvements of this invention.

SUMMARY OF THE INVENTION

The present invention relates to a composition for use as a plating bath in a process for mechanical plating of objects in rotating tumbling barrels comprising:

a liquid vehicle, a flux, at least one coating metal dispersed in said vehicle, a plurality of pieces of rubbery resilient material which aid in forming a very permeable mix, producing random movements of the objects being plating and cushioning the moving parts being plated, thereby preventing large crushing impacts so that there is no chipping or damage done to sharp edges and corners and further permitting the use of large, heavy work pieces without chipping or damage to the resultant coating; and a sufficient amount of a very powerful emulsifying agent capable of floating off all oil and grease films from the objects, said composition making possible metal plating of desired thickness without the limitation of being unable to build on a smooth highly polished coating, so that metal coatings may be six or more mils thick.

In another embodiment the present invention also relates to a process for plating at least one object in a rotating tumbling barrel comprising:

placing into said barrel a composition comprising a liquid vehicle, a flux, at least coating metal dispersed in said vehicle, a plurality of pieces of rubbery resilient material forming a very permeable mix, and a very powerful emulsifying agent capable of floating off oil and grease films.

placing at least one object into said barrel, and rotating said barrel.

In yet another embodiment the present invention relates to an article of manufacture produced in accordance with the process of the present invention.

DESCRIPTION OF THE PREFERRED EMBODIMENTS

This invention in the art of barrel plating related to three major elements that, taken together, produce an outstanding improvement over the prior art. These three elements are:

(1) The elimination of glass beads and the substitution of a small amount of hard quartz sand that can be thrown away after each plating run or a combination of cheap irregular glass beads and sand that can be thrown away after each plating run.

(2) The replacement of the heavy load of fine glass beads designed to reach into thread roots and admixed with very expensive glass balls that are hard to pump, with heavy rubber pieces that will sink into the plating slurry. These rubber pieces are cut into assorted lengths and act to lift and turn the rotating workpieces and act to increase the permeability of the mix and thereby increase the plating efficiency whereby most of the zinc is utilized reducing or eliminating waste disposal problems.

(3) Very substantial improvements in the chemistry used. These improvements involve the use of chemicals that so far as I know have not been used before in any form of mechanical plating. These new chemicals involve such safe and non-hazardous material as chemicals used in bubble baths, skin care lotions, shampoos, eye drops, and a new type of potent metal cleaner.

The bubble bath mixtures provide a heavy foam capable of carrying substantial amounts of Zinc in it. In mechanical plating it has always been customary to use anti-foamers to prevent the foam from carrying not only the fine glass beads out of the rotating mass but also the Zinc dust. In this invention, the use of the rubber keeps the work tumbling in random directions and is lifted by the rubber so that the work is carried up in the foam and excellent coverage and very heavy coatings are obtainable since both the rubber and the heavy foam act as cushioning agents preventing chipping on sharp edges and corners especially important with large heavy objects of 5 to 10 pounds or more. Since there is no glass to break on impact with such heavy objects and since the mix is more permeable, it is easier for the metal powder such as Zinc carried in the foam to reach its target and become incorporated into the coating.

The superb de-oiling and degreasing of the new chemistry facilitates the fast and efficient utilization of all of the zinc.

This specification will discuss the improvements over the prior art as presently practiced and the effect of these three major improvements in detail.

Critical to the success of barrel plating, especially for heavy objects, is the impact media. Small pieces of nonmarking abrasion resistant rubber such as small rubber circles added to the usual glass impact mixture, will not only eliminate chipping on sharp edges, corners, the crests of threads, but also will exert a polishing and smoothing actions, so that the resulting product is smooth and bright.

It is essential that the right kind of rubber is used. Some rubber, high in carbon content will rub off in the form of a fine rubber dust. These become plated with Zinc and are incorporated into the coatings. These coatings are very bright smooth and have a metallic color. There are no indications that any rubber is present in the coating, however, when the Zinc is pickled off in an acid solution, the fine black dust becomes visible. Using non-marking rubbers such as gum rubbers, butyl rubbers, non-marking neoprene rubbers such as are used for barrel and tank linings a beautiful result is achieved.

Aside from preventing chipping, these rubbers provide a better lift and a better interruption of streamline flow than do the glass media as presently used. They are heavy and do not float, ride evenly dispersed throughout the mix and provide not only sufficient lift, but also protection against chipping, while at the same time provide smoothing and polishing and altogether a better looking finish and product than hitherto available. Excellent results have been obtained when two square feet of white neoprene rubber $\frac{3}{8}$ inch thick with very slick, smooth surfaces on both sides was cut into 200 pieces with the majority of the pieces about $\frac{1}{2}$ inch to 2 inches long. Other pieces $\frac{1}{2}$ inch wide and up to 12 inches long were used in a hexagonal barrel approximately 9 inches in diameter and eleven inches in length with a neoprene rubber lining.

A variety of other sizes and shapes have been investigated, some small round solid rings one eighth of an inch thick, another lot was cut into small diamond-shaped pieces, another batch consisted entirely of small pieces of non-staining white neoprene rubber cut into small $\frac{1}{4}''$ cubes—no sand or irregular glass was used. In another run the rubber impact media was all in small pieces ⅛" thick by ¼" long by ½" wide. One series of runs was made of round discs about 3" in diameter. Small rubber balls about one inch in diameter were used and a variety of different rubbers were tried.

This rubber impact media containing very small amounts of quartz sand with its desirable abrasive action for additional surface cleaning and its desirable low price with or without very small amounts of cheap irregular glass beads is most suited for interrupting the symmetrical flow of the work during rotation in a hexagonal horizontal barrel. This is because the flat pieces of rubber in assorted lengths make the work move in a helter-skelter fashion through the permeable mix.

This is highly desirable in securing uniform coverage on an object like a large bolt where the metal coating like Zinc is virtually almost always much thinner at the junction of the head and the shank. This is because the thread end travels first in moving in a symmetrical flow in a rotating barrel, and the streamline flow does not penetrate well into the junction of the head and shank. With the rubber mix the bolt travels in a topsy-turvey manner, and the projecting head extending beyond the shank actually captures more of the Zinc so that for the first time the junction of head and shank may have a thicker coating than the rest of the bolt. Pole line hardware comes in an infinite variety of shapes and sizes. Some of these pieces travelling in the customary symmetrical flow of the conventional fluid glass bead flow are almost impossible to get uniform coverage and one particular piece was virtually impossible to plate on a small area. The use of the rubber-sand mix solved the problem at the very first try.

The use of large rubber pieces that are extraordinarily large compared to the glass beads is a new concept. These large heavy pieces travelling in the rotating mass actually do a superb job as impactors, covering large areas with a heavy sliding motion that makes a smooth coat. The sharp cut edges will actually act to coat the threads of large bolts; for very fine threads, glass beads or sand in small amounts are necessary.

This invention virtually eliminates the use of glass. The amount used is so small that it can be thrown away after each run. The amount of glass used is hardly enough to cover the bottom of the barrel and in many cases can be eliminated entirely. The small amount of glass is used to plate threaded work. The permeability of the mix using heavy rubber is so good that the small amount of glass finds easy access to the threads because of the virtual lack of impedance.

If the glass is eliminated entirely, then it can most advantageously be replaced by a small amount of harsh quartz sand. Normally sand is not used because of the tendency to become lodged in threads or other tight places, such as recessed areas. The lubricating properties of the new chemistry are superb, however, and prevent lodgement. For all large objects such as pole line hardware, the threads are large and open so lodgement is not a problem. If the glass beads are used, they are used at about 1/10 or less of the usual amount. Because of the lubricants of the mix, very cheap, small irregular beads can be substituted for the expensive round glass beads.

The lack of impedance provides wonderful access to the work being plated with the result that the large amounts of Zinc can be added at one time, and utilizes all of the Zinc very quickly.

Surprisingly, the smooth rubber produces a smoother coating and is better than that produced by glass. The many millions of glass particles can be replaced as noted above, by two hundred to two hundred fifty pieces of rubber (for example, ½" wide). These are cut into assorted lengths ranging from 12" to ½" or smaller. This acts to turn the parts revolving in the barrel.

To go with the improved rubber containing impact media, this invention discloses a new kind of chemistry using classes of chemicals not known to me to have been used before. One characteristic of some of these groups is a superb ability to emulsify oils, greases and the like that are not ordinarily capable of emulsification with the chemistry of the past. This high emulsification factor makes it possible to use chemicals of a kind and in quantities not feasible otherwise. For example, some silicones are oily and greasy in themselves and are not soluble except in aromatic solvents such as Xylol and Toluol. Their use over prolonged periods will build up heavy silicone films on the glass impact media and on the work and plating will be hindered or be stopped entirely. Consequently they cannot be used in barrel plating except in minute amounts because they film not only the work itself, but also the glass media and the sides of the barrel. These materials are excellent lubricants and can do an excellent job of plating in threads but with continuous use they will build up such a thick adherent film that all plating virtually stops. Since these chemicals are from the most part not soluble in acids like Sulphuric their use was not practical in the past. The new chemistry uses emulsifying agents of such power to emulsify and dissolve all types of oil and grease to provide clean metal surfaces which up to now are unknown to barrel plating. The clean metal to metal contact is of such magnitude that it makes possible the elimination of coppering entirely except for the use of an activating rinse containing a dilute solution of Sulphuric acid with a dilute solution of Copper Sulphate, so dilute that a ten-second immersion will show no Copper or virtually no Copper color on the steel. Alternatively, the rinse may consist of Sulphuric acid in dilute solution with the emulsifier. This degree of clean metal to metal contact makes plating the roots of thread easy. An alternative to the use of Copper is a weak acid and one of the very powerful emulsifiers of the new chemistry such as Dodecyl thio ether mercaptan. A ten to twenty second immersion in a hot solution will do a splendid job of activating the surface of the work prior to adding to the plating barrel. The use of previously unusuable silicone lubricants now properly emulsified makes the recessed areas and holes that occur so frequently in pole line hardware easy to plate.

The incorporation of promoters into these materials makes possible most excellent Zinc coatings with tremendous penetration into recesses and utilization of almost all the Zinc. The Zinc efficiency being well above that of the prior art where substantial amounts of excess Zinc are dissolved in strong Sulphuric acid at the commencement of every run in an open-ended conical barrel to permit escape of the substantial amount of gas generated as described in published area.

The combination of this superior chemistry with a rubber glass impact media acting together simplify and improve over past practice.

The concept of adding powerful emulsifiers capable of dissolving all kinds of greases and oils including silicones is new to barrel plating. The emphasis of the prior art has been to film the work and then to displace the film when the discrete metal particles are flattened. This invention on the contrary, removes almost all films during the flattening operation.

The emulsifiers act as extraordinarily efficient metal cleaners, removing rust or contaminants.

These metal cleaners in the barrel improve the Zinc efficiency, and make important reductions in the time necessary to plate out all the Zinc.

As noted above it eliminates the necessity of coppering the work in the conventional way, eliminates the need for adding Tin and provides a better finish. One of the best of these metal cleaners contains a Sulphur atom in the center of the molecule that breaks at this location when exposed to hot oxidising acids such as Sulphuric acid, and although it is not desired to be limited to any theory, it is not unlikely that there may be a combination with a silicone molecule to create a new type of metal container.

This same new type of chemistry may be used in both the high speed mechanical process for plating steel strip and for use in the portable galvanizer. An important advantage in these two processes is that it is used in much smaller quantities and is very economical. In barrel mechanical plating, because of the extremely large surface area contained in say three thousand pounds of small bolts, the new chemistry may be overextended. For this reason, additions may be made of hydrocarbon surfactants that are used in conventional plating such as the Tetronics family.

Up until now, all commercial mechanical barrel plating has been done in a water solution. Despite frequent attempts every time a new advance was made in technology, all efforts to plate metals such as Aluminum that always have an oxidized surface have failed. It became apparent that to successfully barrel plate Aluminum it would have to be done in a completely dry environment. The chemistry used also had to be completely devoid of any moisture. In aqueous plating as commercially practised filming agents are added to protect the particles of coating metal. These films are extruded by impact that removes the films and flattens the particles that are interfitted one with another.

In an entirely dry operation, the chemistry should create the same conditions. Many suitable dry promoters exist. One of the best is a poly- oxyethylene powder or flake and is sold commercially under the trade name of HiFax. The criteria for success is that the chemical promoters should contain no water. Some silicone polymers and copolymers meet these specifications. A sodium $C_{14}$–$C_{16}$ Olefin Sulfonate is a dry flake and a powerful detergent and filming agent and meets the criteria.

In the practice of the invention, the barrel is dried usually with a heat lamp. The metal powder is dried usually under a heat lamp, and the work to be coated is also dried under a heat lamp. The impact media, usually round iron shot previously coated with the coating metal, is also added to the barrel when hot. The heat is retained in the barrel which is usually rubber-lined with about a one-inch thick rubber, usually neoprene.

Dry plating can be practiced in an unlined barrel because although the interior surfaces of the barrel become coated with coating metal, the coating on the barrel walls becomes intensely smooth and shiny and refuses to accept additional coating. The promoter of choice in most of the experimental runs was always the HiFax. The hotter and drier the barrel and its contents, the thicker the coating. Plating may be slower than in the aqueous system if heavier coatings are required.

The principal advantage of the dry process is that it is the only method so far as we are aware that can be used to mechanically plate smooth attractive coatings of metals such as Aluminum and Nickel. It can also be used to plate Zinc, Tin, Cadmium, and composites of these. Usually one metal powder added to the barrel under the above listed conditions will encapsulate the other. For example, in one series of experiments equal weights of Copper and Aluminum powder were added to the mill. The coating came out looking exactly like Aluminum. On salt spray tests, the aluminum dissolved and the Copper was left behind. The voltage difference (emf) between Copper and Aluminum exposed to a salt spray electrolyte caused the aluminum to dissolve anodically, leaving only the Copper behind. Very fine excellent quality Aluminum coatings are obtainable by the dry process.

The barrel should be about 60% full. The work to be plated should be covered by the coated shot (the impact media). The dry promoter system is added together with the coating metal powder, usually Aluminum powder, and the barrel is rotated. On a large barrel (approximately five feet) with high energy, the coating was applied in about 30 minutes but the coating was thin. On small barrels such as 10-inch diameter, it takes two to three hours to lay down a coating of about 1 mil.

An Explanation of the Examples That Follow

The research was done in three sizes of barrels. For very small loads of 1 to 5 pounds, a hexagon rubber-lined barrel, 7 ½" across the flats by 8" high; for intermediate loads of 5 to 35 pounds a barrel with removable rubber liners of 10" across the flats by 12" high; for larger loads, barrel of 15" diameter by 14" high.

A problem with all barrels is too much symmetry of flow of the rotating mass. Rubber balls about 4" in diameter are used to prevent nesting together of certain types of cupshaped washers. The 4" balls serve a dual purpose. They break up the symmetrical flow and prevent nesting. Since only about a pailful is used, they are easy to remove from the system after each run.

In the examples that follow, small pieces of rubber are used, not so much to break symmetry, which they do anyway, but to simplify the process which they do very well, and to prevent chipping and wear on large objects. The 1987 Metal Finishing Handbook puts a limit of 2 lbs. in weight and 12" in length for all batch-plated parts. This restriction limited the size of the market to small articles like small fasteners and the like and the bulk of this market goes to the hot dippers.

One of the objectives of the research disclosed in the examples was to open up the mechanical plating process for coating of all articles that can be tumbled irrespective of size, weight, or geometry and without limitations on coating thickness. The examples will show that we were successful in this.

The examples disclose different procedures in the use of rubber of various types, shapes and sizes. They disclose the use of small pieces and the complete elimination of all sand and glass media. This all rubber does not and cannot wear away, break or be damaged so it is permanent and easily separated from the mass of the charge. Everything is thrown away at the conclusion of each run, except the rubber impact media and the work being plated. This leads to a tremendous simplification of the process.

At a ratio of two pounds of glass beads per pound of work, the job of removing and returning tons of disintegrating glass (as a result of impact) is far more expensive and time-consuming than the removal of a small amount of rubber that does not break up.

In reviewing the examples, it should be noted that extensive and heavy foam was generated by the new chemistry, which in turn served as a further cushioning means and also served as a transporter of the metal powder that was exposed to the action of the chemicals working on the individual grains of zinc while it was contained in the foam.

Examples of suitable rubbers that have been found to work well in the process are the following: the heavy rubbers such as neoprene sink into the rotating mass and remain there. This is highly desirable particularly when large heavy objects are being coated. The gum rubbers are much lighter and tend to congregate on the surface and have been used usually in long lengths which act to cause random orientation of the work being coated. The silicone rubbers have very smooth surfaces and tend to produce a good polish on the work being coated. The butyl rubbers have the advantage of being very inert and compatible with most environments.

EXAMPLE 1

This example discloses the plating of pole line hardware with Zinc in which the coating thickness will exceed 8 mils. If no Zinc is present on the pole line hardware (usually the case) then this example will apply to almost all types of hardware.

Take approximately 35 pounds of assorted pole line hardware. The pieces used for this test were old and been thrown away years previously. When they were received, some threaded bolts had the threads completely rusted away.

The pieces were badly stained with red rust and dirt and were unattractive in appearance. An examination disclosed that in places under the rust there were from three to five mils of Zinc that apparently had been stained by rust from surrounding areas of rusted steel.

Step #1

To clean off all the rust and expose clean steel down to bare metal on areas from which all the Zinc had been removed without losing any of the Zinc, which could be reclaimed by plating new Zinc over the old.

Two methods were used on two different batches. One was sandrolled. The work was placed in a hexagonal small barrel and was covered with warm water. Depending on the size of the load, approximately 10 grams of lime was added for a 40-pound load of assorted pieces of pole line hardware. To this was added 20 ccs of a powerful metal cleaner and emulsifier consisting of, for example, a Thio Ether Mercaptan capable of floating away all oil and grease and preventing it from re-settling. This material works well in alkali solutions. The barrel was rotated for 45 minutes. On opening the work was found to be free of all oil and grease. None of the Zinc on the work appeared to have been lost. The thickness readings before and after the sandrolling were virtually unchanged. There was no rust. The threaded pieces had been well-scrubbed by the sharp Quartz Sand. There was no lodgement of sand. The pieces were well washed and transferred to another barrel that was clean and free of oil and grease.

For ordinary coating thickness of Zinc, only one addition of Zinc is needed. It is advantageous to put a thin coating of Tin over the pole line hardware. This is done by adding 10 to 20 grams of tin to the plating charge, together with a plating promoter containing an acid flux, such as sulphuric acid, which is made up as a 10% solution by volume with water and a blend of silicones, a powerful emulsifying agent and impact media. The total blend of silicones would not exceed 12 ccs. The barrel is rotated at about 35 rpm for 10 to 15 minutes to deposit a thin Tin coating over the surfaces. The barrel is opened and the full amount of Zinc needed for the desired thickness of, say 3–5 mils is added, fresh promoter chemicals and 2 ccs of the silicone blend are added and the work is rotated for about 25 to 30 minutes when all of the Zinc will be used up.

For very heaving coatings (which this chemistry makes possible) of, say, 6, 10, or 12 mils, two separate additions of Zinc are added with a small amount of additional promoter. The amount of Zinc added will depend on the thickness required. It is not necessary to add additives for the second and third runs. The effectiveness of the promoter system using the powerful thio ethers is improved most markedly by the addition of the blend of silicones which are most necessary for success. These silicones are blended together and are added at the rate of 2 ccs, but only one addition of these silicones is made for a single stage run or for a three-stage run of the coating metal as Zinc.

An alternative to sandrolling is to use a powerful emulsifier such as ethoxylated oleyl alcohol or a thio ether in an acid solution in hot water. To the metal cleaner an alcohol is added, about 2 grams of the cleaner and 2 ccs of sulphuric acid in a 10% solution of water are added. This is an excellent way of degreasing and de-oiling, but may not be suitable if Zinc is present on the work.

The impact media for this new system consisted of small pieces cut from $\frac{3}{8}''$ thick white non-staining, high density neoprene rubber, having smooth, shiny surfaces. The majority of the pieces were cut into $\frac{1}{2}''$ lengths and 6" lengths with three or four of 12" lengths. The permeability of the mix was so excellent that all of the metal powder for a charge of 6 mils can be added at once, but for heavier coatings, two runs would be added as noted above.

A thick, heavy foam was generated by most of the chemistry.

EXAMPLE 2

A repeat of Example #1 except that the rubber pieces were cut from sheets of silicone rubber $\frac{1}{8}''$ thick in pieces of $\frac{1}{2}''$ square. The silicone rubber had smooth highly polished surfaces.

EXAMPLE 3

As in Example 1 except that the rubber of the same size and dimensions as Example 1 was cut from butyl rubber.

EXAMPLE 4

Same as in Example 1 except that the white, high density non-staining neoprene was cut into $\frac{3}{8}''$ cubes. In another case they were cut into $\frac{1}{4}''$ cubes; in another case, they were cut into $\frac{1}{8}'' \times \frac{1}{2}'' \times \frac{1}{2}''$ pieces. These pieces sank like stones when dropped into the plating solution. This is important because the rubber pieces remain within the charge.

EXAMPLE 5

As in Example 1 except the rubbery material is made from $\frac{3}{8}''$ polyethylene or the like.

EXAMPLE 6

As in Example 1 except that the rubbery pieces were cut from gum rubber.

EXAMPLE 7

Object of this example was to take pole line hardware that had been reclaimed from the trash heap of a utility company and replate it. This pole line hardware was rusted in spots, was badly stained over all with red rust and over a substantial area had 5 to 8 mils of zinc which we wished to retain. An object was to simultaneously and without removing the work from the barrel, remove the rust, clean off the remaining zinc and produce a uniform zinc coating over all surfaces.

The work was placed in a hexagon rubber-lined barrel. Sharp quartz sand admixed with small pieces of high density, white, non-staining neoprene rubber. To this was added a washing degreasing solution containing water, alcohol, and a powerful metal cleaner, in this case it was an ethoxylated thio ether mercaptan with 12 moles of ethylene oxide. When all rust, oil and grease were gone, the barrel was drained of this liquid and washed with hot water but without removing any of the solid contents. To this was added:

4 ccs of mixture of silicone silicate, silicone emulsion, eleyl alcohol ethoxylate, silicone resin coating and a dimethyl fluid 30 grams of tin 100 ccs of mixture of thio ether ethoxylate, sulfuric acid and water Water at 100 F. to cover On opening the barrel after 20 minutes, there was still rust and scale showing. The barrel was closed and run another 10 minutes when all the rust and scale had been removed. All the tin powder had been plated on the work—no tin powder left.

Without removing any of the content, the following was added:

100 grams of zinc dust 150 grams of a mixture of thio ether ethoxylate, sulfuric acid and water 2 ccs of a mixture of silicone silicate, silicone emulsion and a dimethyl fluid Run was continued for 30 minutes. All zinc was used up. A very attractive, highly polished, very uniform, very thick coat was achieved. There were no thin spots on any of the pieces. It is not normal practice to mix the articles to be plated, but in this case there was a very substantial generation of a very thick foam that prevented chipping that would otherwise have occurred in mixing articles with a substantial variation in weight and geometry.

It is noteworthy that the degreasing, removal of rusts, and rust staining, the preparation of the substantial amount of residual zinc left on the work for plating, and the absence of any detectable loss of zinc all took place as a single operation without removing anything solid from the barrel constitutes an important simplification of the mechanical barrel plating process. The high concentration of silicones used presages the probably absence of white corrosion on the zinc plates, with attendant loss of zinc, is an important improvement.

EXAMPLE 8

Approximately 20 pounds of pole line hardware of assorted shapes and sizes was sandrolled in sharp sand sufficient to cover the work, warm water was added about 1" over the top of the same. Seven grams of line was added and the barrel was agitated for forty minutes. When the barrel was opened, the work was nicely etched and free of all oil, grease, rust and there was no water break. The work was removed from the barrel and well washed and then returned to the barrel for the coating stage. The work was then processed as in Example 7 with similar results, exceptionally heavy coating, polished, smooth, uniform coverage and no chipping.

EXAMPLE 9

Clean, greaseless pole line hardware was placed in a hexagonal barrel. The work was then covered to a depth of 1" with $\frac{1}{4}''\times\frac{1}{4}''\times\frac{1}{4}''$ pieces of nonstaining, white neoprene rubber. No sand, no glass beads were used. The only impact media was the rubber pieces. Following the plating procedures shown in Examples 7 and 8, a very beautiful result was obtained. All the zinc was used up.

EXAMPLE 10

About 20 pounds of pole line hardware with clean surfaces free of rust, scale, oil or grease was activated by immersing for 10 seconds in a dilute solution of copper sulphate dissolved in an aqueous dilute solution of a 50/50 by volume of hydrochloric and sulfuric acid. On removal and washing in warm water, there was a perceptible pink coloration from the copper sulfate. The plating procedure of Examples 8 and 9 was followed with a very smooth attractive coating that resulted.

EXAMPLE 11

In a plating run identical with Example 10, except that the $\frac{1}{4}''$ cubes of neoprene, white, non-staining rubber was replaced with $\frac{1}{8}''$ thick by $\frac{1}{2}''$ wide by $\frac{3}{8}''$ long rubber pieces.

Again there was a very heavy foam and again there was no chipping or wear on any of the sharp edges or corners and once again as in the proceeding examples in which rubber was the only impact material used the high concentration of powerful lubricants in the silicones had provided a good smoothness and a good uniformity of the coating.

EXAMPLE 12

The tests of Examples 9 and 11 were repeated except that 6 pieces of round neoprene, white, non-staining rubber of 8" length were added to the run to increase the action in the barrel and to interrupt any tendency of the streamline flow to occur. Again a highly polished, very attractive coating was achieved.

EXAMPLE 13

This example relates to barrel mechanical plating done in a completely dry environment, in which everything put into the barrel used for plating including the barrel itself is dried under heat lamps or in ovens to ensure the complete absence of any moisture. High purity aluminum powder, lamp dried, is used for the coating metal.

The promoter system itself has to be dry. In this example, fine powdered polyethylene was dried.

Approximately 5 lbs of work was covered with iron shot impact media (about $\frac{1}{8}''$ diameter that was previously coated with aluminum and which was bone dry). An excess of aluminum power was used—100 grams. The barrel, equipped with circular ends fitted to run on rotating shaft rollers, was placed on the rollers and the heat lamp placed over the barrel to keep it warm. A small hole can be drilled in one circular lid, the hold being covered by the rubber gasket to provide a safety valve. The barrel was rotated for about 4 hours at ¾ of critical speed. At the end of the run, the barrel was allowed to cool before opening. The work was covered with an attractive aluminum coating.

EXAMPLE 14

The above example was repeated but instead of aluminum powder, finely chopped ribbons were used. These aluminum ribbons are incorporated into the coating as long slivers of aluminum lying on edge with the broad side parallel to the steel substrate. Micro photographs of these ribbons showed that they were so long that it took four or five photographs fitted and pasted together to illustrate the structure and size of these ribbons emplaced within the coating.

What is claimed is:

1. A process for plating at least one metal object in a rotating barrel comprising:

Placing into said barrel a composition comprising a liquid vehicle, a flux selected from the group consisting of acid fluxes and alkali fluxes, at least one coating metal dispersed in said vehicle, a plurality of pieces of rubbery, resilient material forming a permeable mix, at least one powerful emulsifying agent capable of floating off oil and grease films, and an amount of glass impact media which is significantly less than the industry standard of two pounds of glass impact media per pound of metal objects to be coated due to the presence of said rubbery, resilient material, placing at least one metal object into said barrel, and rotating said barrel.

2. A process as claimed in claim 1 wherein said composition further comprises a sufficient amount of a plurality of silicone fluids to improve the quality of the resultant coating and to provide additional lubrication.

3. A process as claimed in claim 2 wherein said composition further comprises a sufficient amount of at least one hydrocarbon surfactant to aid in lubrication and filming of the plating bath.

4. A process as claimed in claim 1 wherein said object comprises a plurality of pipes of different diameter substantially evenly dispersed throughout the rotating charge.

5. A process as claimed in claim 1 wherein said flux comprises an acid flux.

6. A process as claimed in claim 1 wherein said flux comprises an alkali flux.

7. A process as claimed in claim 1 wherein said composition further comprises a foaming agent capable of producing a substantial foam which is able to carry said metal powder and any fine impact media.

8. A process as claimed in claim 1 wherein said coating metal comprises a metal powder.

9. A process as claimed in claim 1 wherein said coating metal comprises a plurality of metal ribbons.

10. A process in accordance with claim 1 where said composition further comprises sand.

11. A process in accordance with claim 1 where said rubbery resilient material comprises natural and synthetic rubbers.

12. A process in accordance with claim 1 wherein the glass beads comprises irregularly-shaped glass beads.

* * * * *